US008616435B2

(12) United States Patent
Crabtree et al.

(10) Patent No.: US 8,616,435 B2
(45) Date of Patent: Dec. 31, 2013

(54) MAILBOX ACCESSORY DEVICE

(76) Inventors: Larry Crabtree, Johnston City, IL (US); Jan Jansco, West Frankfort, IL (US)

( * ) Notice: Subject to any disclaimer, the term of this patent is extended or adjusted under 35 U.S.C. 154(b) by 0 days.

(21) Appl. No.: 13/280,917

(22) Filed: Oct. 25, 2011

(65) Prior Publication Data

US 2013/0098979 A1 Apr. 25, 2013

(51) Int. Cl.
*A47G 29/14* (2006.01)

(52) U.S. Cl.
USPC ..... 232/29; 232/17

(58) Field of Classification Search
USPC ..... 232/17, 29, 33, 45; 220/8, 23.87; 206/557; 211/175
See application file for complete search history.

(56) References Cited

U.S. PATENT DOCUMENTS

| | | | | |
|---|---|---|---|---|
| 5,009,366 | A * | 4/1991 | van Druff et al. | 232/17 |
| 5,060,900 | A * | 10/1991 | Kokoruda et al. | 248/311.2 |
| 5,765,749 | A * | 6/1998 | Harper | 232/17 |
| 6,997,373 | B2 * | 2/2006 | Flores | 232/29 |
| 7,000,826 | B2 * | 2/2006 | Billings | 232/29 |
| 7,210,616 | B1 * | 5/2007 | Van Watermulen | 232/29 |
| 7,451,912 | B1 * | 11/2008 | Taube, II | 232/29 |
| 2005/0247770 | A1 * | 11/2005 | Priest | 232/20 |
| 2006/0022028 | A1 * | 2/2006 | Thomas | 232/29 |

* cited by examiner

*Primary Examiner* — William Miller
(74) *Attorney, Agent, or Firm* — Husch Blackwell LLP

(57) ABSTRACT

A mailbox accessory device for insertion within the cavity of a mailbox for more easily accessing mail located towards the rear portion of the mailbox including a first member extending along at least a portion of the length of the mailbox cavity, the second member being coupled to the first member. The mailbox device is movable within the mailbox cavity from a position wherein the second member lies in the vicinity of the rear wall of the mailbox to a position wherein the second member lies in the vicinity of the access opening of the mailbox. The second member extends above the first member and engages mail located in the mailbox cavity so as to move such mail to the access opening of the mailbox.

6 Claims, 2 Drawing Sheets

MAILBOX ACCESSORY DEVICE

BACKGROUND OF INVENTION

The present invention relates generally to a mailbox accessory device and, more particularly, to a mailbox slide mechanism which enables a person to more easily access mail located towards the rear or back portion of the mailbox.

Mailboxes come in a variety of different sizes and shapes. Mailboxes which are typically located adjacent a street or road typically include an elongated enclosed housing structure having an access door located at one end portion thereof for providing access to the interior of the mailbox. These mailboxes are likewise typically located on a pole or other upright supporting structure and are oriented for easy access by the mail carrier especially from inside a vehicle. This height orientation is likewise suitable for retrieving mail from the mailbox from inside a vehicle. This is particularly true in rural areas where the street or roadside mailbox is typically located a substantial distance from the home or residence and is not typically within a convenient walkable distance from such home or residence.

Depending upon the size and depth of a typical street or roadside mailbox, mail articles and pieces located towards the rear or back portion of the mailbox structure are sometimes difficult to reach particularly when one is accessing the mailbox from inside a vehicle. Due to the distance between the vehicle and the access door of the mailbox, the depth of the mailbox and the arm length of the person trying to access the mail from the vehicle, those mail articles and pieces located towards the back of the mailbox may not be reachable. In this situation, the driver is usually forced to open the vehicle door and either lean forward or step out of the vehicle in order to access those particular mail pieces. Age, physical disability, and other factors may likewise contribute to one's difficulty in retrieving mail pieces located in the back or rear portion of a particular mailbox.

Thus, there is a need for a device which will enable a person to more easily retrieve mail pieces located at the back or rear portion of a particular street or roadside mailbox, particularly, when a person is retrieving such mail from inside a vehicle. The present invention is directed to a mailbox accessory device which overcomes the problems set forth above and allows a user to more easily access mail pieces located within a typical street or roadside mailbox regardless of the location of the mail pieces within such mailbox.

SUMMARY OF INVENTION

The present invention is a device which is easily insertable into a typical street or roadside mailbox and includes a first elongated member which extends substantially the full length or depth of the mailbox cavity and a second transverse member which extends substantially the full width of the mailbox cavity when the present device is inserted therewithin. The second transvers members is attached to or otherwise formed integrally with the first elongated member and extends thereabove across the width of the mailbox cavity. The first elongated member may include a finger hole or other opening located towards its terminal end portion located near or adjacent the access opening to the mailbox for easy grasping by a user. When positioned within a particular mailbox, the first elongated member is slidable within the mailbox cavity between a fully inserted or storage position wherein the present device is located completely within the mailbox cavity and a plurality of extended positions where the first elongated member extends through the access opening of the mailbox and the transverse member is located between the access opening and the rear wall of the mailbox. When mail or other articles are positioned within the mailbox cavity, such mail will rest upon the first elongated member. As a result, as the first elongated member is pulled out of the mailbox access opening, the transverse member is likewise moved within the mailbox cavity from a position adjacent the rear wall of the mailbox to a position closer to the access opening of the mailbox. As the first elongated member is pulled forward out of the access opening, the transverse member will engage and contact mail pieces within the mailbox cavity and move those mail pieces forward towards the access opening. When mail is removed from the mailbox, the first elongated member is pushed back into the mailbox cavity to its storage position and the access door is closed.

Since street or roadside mailboxes typically come in different sizes, shapes, depths and widths, in one embodiment of the present invention, the first elongated member is sized so as to correspond substantially to the overall length or depth of the particular mailbox into which it will be inserted and the second transverse member is sized so as to correspond substantially to the overall width of the mailbox into which it will be inserted. In another embodiment of the present invention, the first elongated member can be made adjustable so that it can be adjusted lengthwise so as to correspond substantially to the overall length or depth of the mailbox into which it will be inserted, and the second transverse member can be made adjustable so that it can likewise be adjusted laterally so as to correspond substantially to the overall width of the mailbox into which it will be inserted. This adjustability in both directions enables the present device to be adapted to accommodate a wide variety of differently sized street or roadside mailboxes regardless of their overall depth and width.

These and other aspects and advantages of the present mailbox accessory device will become apparent to those skilled in the art after considering the following detailed description in connection the accompanying drawings.

BRIEF DESCRIPTION OF DRAWINGS

For a better understanding of the present invention, reference may be made to the accompanying drawings.

DETAILED DESCRIPTION

Figure 1:
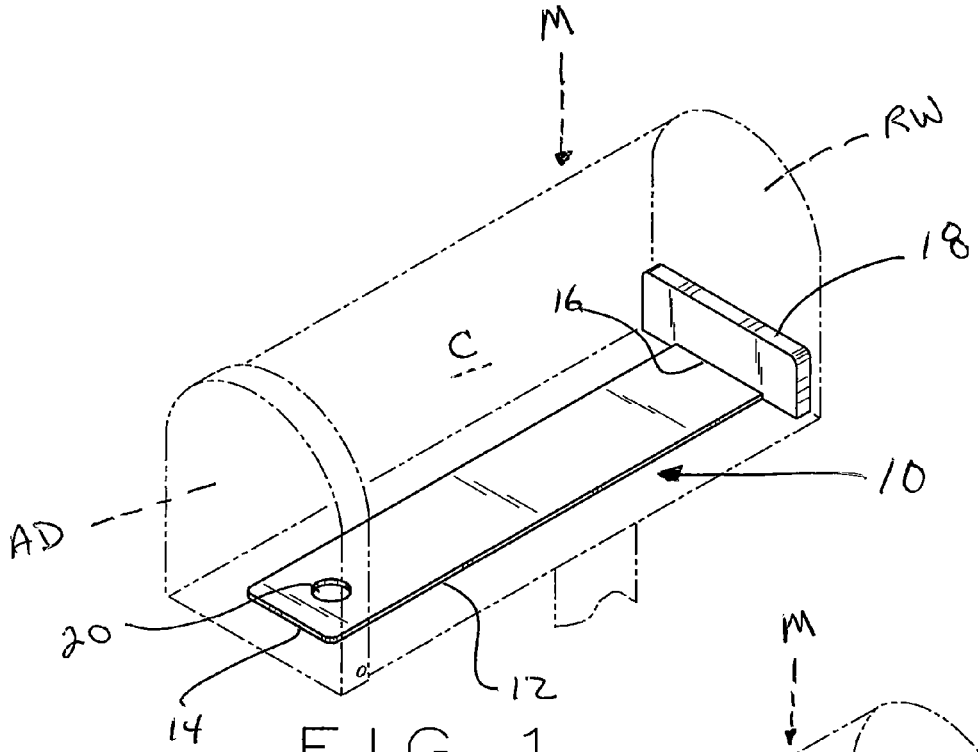
FIG. 1 is a perspective view of the present mailbox device positioned within a typical street or roadside mailbox, the present device being positioned in its fully inserted or storage position within a typical mailbox.
Figure 2:
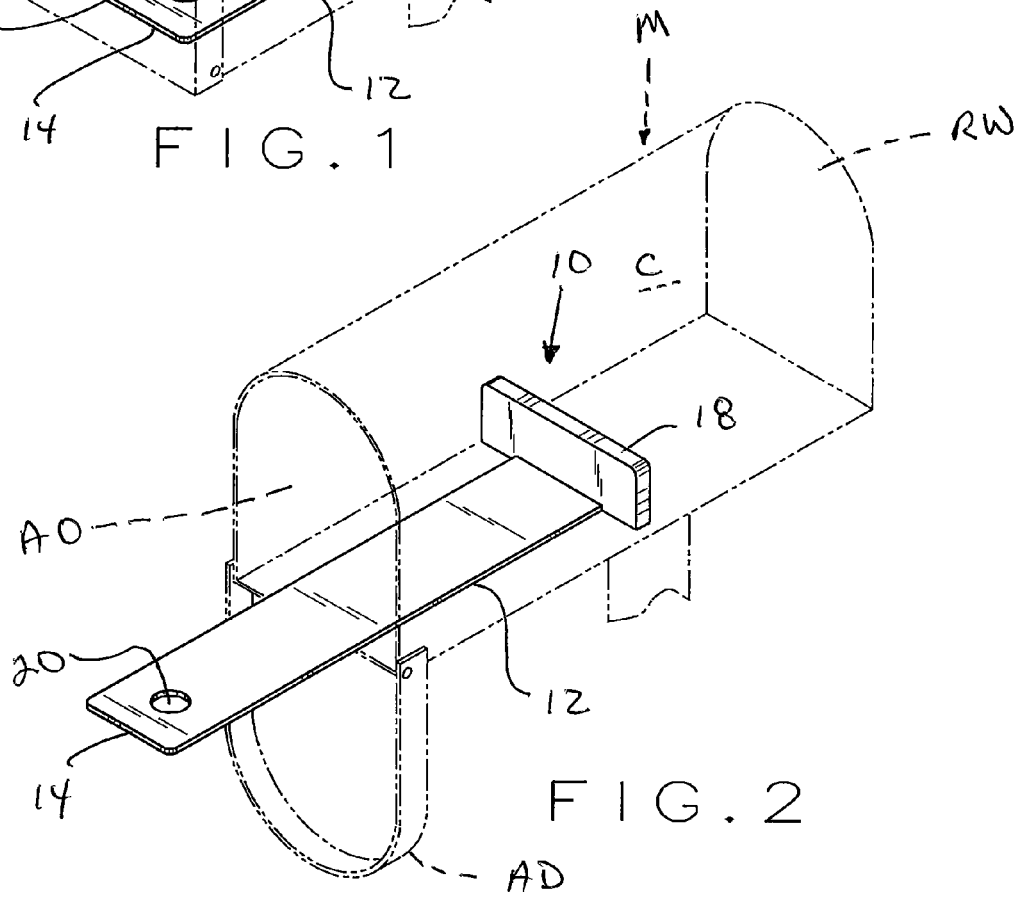
FIG. 2 is a perspective view of the present mailbox device similar to FIG. 1 wherein the present device is shown in one of its pulled or extended positions for retrieving mail pieces positioned within the mailbox.
Figure 3:
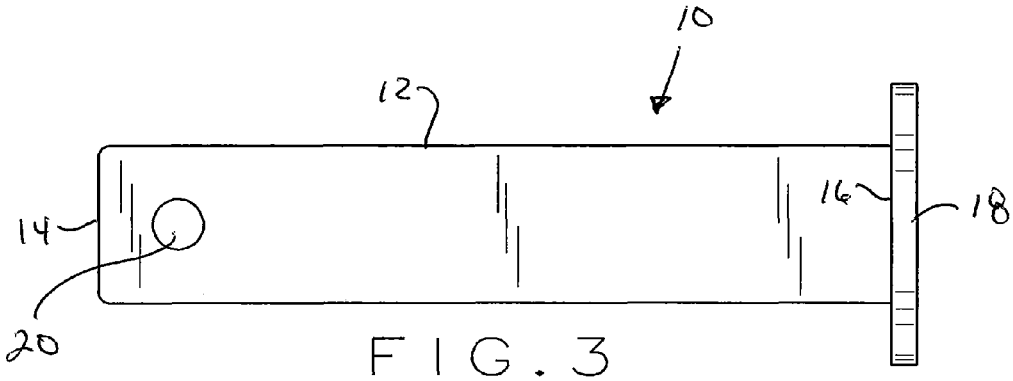
FIG. 3 is a top plan form view of the mailbox device of FIGS. 1 and 2.
Figure 4:
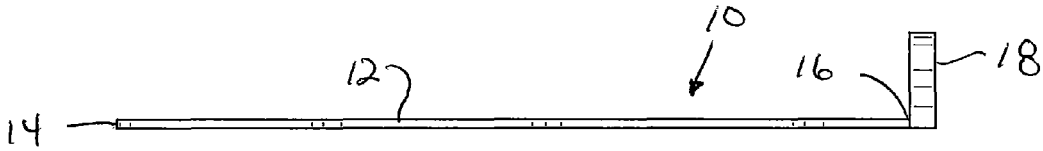
FIG. 4 is a side elevational view of the mailbox device of FIGS. 1-3.
Figure 5:
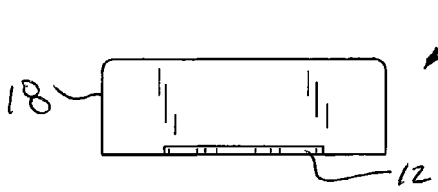
FIG. 5 is a front elevational view of the mailbox device of FIGS. 1-4.

Referring to the drawings more particularly by reference numbers wherein like numerals refer to like parts, the number 10 in FIGS. 1-5 identifies one embodiment of a mailbox accessory device constructed according to the teachings of the present invention. As best illustrated in FIG. 1, the present device 10 is fully insertable within a typical street or roadside mailbox M and includes a first elongated member 12 having opposed end portions 14 and 16 which extends substantially the full length or depth of the mailbox cavity C (FIG. 1) and a second transverse member 18 which extends substantially the full width of the mailbox cavity C. The mailbox M includes an enclosed cavity C, a rear wall RW, an access opening AO, and an access door AD as best illustrated in FIGS. 1 and 2. The second transverse member 18 is coupled or otherwise attached to one end portion of the first member 12 such as adjacent end portion 16 as best illustrated in FIGS. 3 and 4. In this regard, the transverse member 18 can be coupled or attached to member 12 anywhere in the vicinity of end portion 16. In the particular embodiment illustrated in FIGS. 1-4, the transverse member 18 is attached directly to or flush with end portion 16. In other embodiments, it is recognized and anticipated that transverse member 18 can be positioned on top of end portion 16 either adjacent to its terminal end portion 16, or slightly spaced therefrom. Positioning the transverse member 18 substantially near or in the vicinity of end portion 16 will be obvious from an explanation of the intended use of the present device 10. In addition, as best illustrated in FIGS. 1, 2 and 4, the transverse member 18 extends above elongated member 12 for reasons which will likewise be obvious as explained below.

When insertably positioned within a typical mailbox M, the transverse member 18 will lie substantially near or adjacent to the rear wall RW of the mailbox M and the end portion 14 of the elongated member 12 will lie substantially near or adjacent to the access opening AO. In this regard, end portion 14 may include a finger hole or other opening 20 located in the vicinity of its terminal end portion for easy grasping by a finger of the user. The present device 10 is designed to rest upon the supporting floor surface of the mailbox M and slide thereacross as the elongated member 12 is pulled towards a user and out of the access opening AO as illustrated in FIG. 2. In this regard, when fully inserted and positioned within a particular mailbox M as illustrated in FIG. 1, the present device 10 is in its fully inserted, operative or storage position with the transverse member 18 lying substantially close to or in the vicinity of the rear wall RW of the mailbox M. The present device 10 is then slidably movable within the mailbox cavity C between its fully inserted or storage position as illustrated in FIG. 1 to any plurality of extended positions where the first elongated member 12 extends through the access opening AO of the mailbox M and the transverse member 18 is located at an intermediate location between the access opening AO and the rear wall RW of the mailbox M as illustrated in FIG. 2. In this regard, the present device 10 is movable to a plurality of different locations between its storage position and its extended position and the transverse member 18 can be positioned at any location between the rear wall RW and the access opening AO of the mailbox. In other words, the present device 10 is slidably movable within the mailbox cavity C from a position wherein the transverse member 18 is adjacent or close to the rear wall RW of the mailbox M to a position wherein the transverse member 18 is near or adjacent to the access opening AO of the mailbox.

When mail or other mail pieces or articles are positioned within the mailbox cavity C, such mail will rest upon the elongated member 12. As a result, as the elongated member 12 is pulled out of the mailbox access opening AO, the transverse member 18 is likewise moved within the mailbox cavity from a position adjacent the rear wall RW of the mailbox M to a position closer to the access opening AO of the mailbox as illustrated in FIG. 2. As the elongated member 12 is pulled forward and extends out of the access opening AO of the mailbox, the transverse member 18 will engage and contact mail pieces stored within the mailbox cavity C and move those mail pieces forward towards the access opening AO of the mailbox for easy removal therefrom. This movement allows a user to easily access mail located towards the rear wall RW of the mailbox by simply moving or sliding the present device 10 out of the mailbox as illustrated in FIG. 2 so as to move those hard to reach mail pieces from the rear of the mailbox cavity C to the access opening AO of the mailbox. Use of the optional finger hole 20 will facilitate such sliding movement in and out of the mailbox. In other words, to retrieve mail from the mailbox M, a user simply has to open the access door AD of the mailbox, place his/her finger in the opening 20 or otherwise grasp the terminal end portion 14 of the elongated member 12 located in the front portion of the mailbox, and pull the elongated member 12 towards the user until the mail located within the mailbox is easily reachable near the access opening AO. When mail has been removed or retrieved from the mailbox, the present device 10 is merely pushed back into the mailbox cavity C to its storage position and the access door AD is closed. The device 10 is now again ready for operative use.

Since street or roadside mailboxes typically come in different sizes, shapes, lengths or depths, and widths, it is anticipated that the present device 10 will be available in various sizes to accommodate the variation in mailbox dimensions. In this regard, the first elongated member 12 is sized so as to correspond substantially to the overall length or depth of the particular mailbox into which it will be inserted. The elongated member 12 needs to be reachable or accessible from the access opening of the mailbox and therefore needs to extend along at least a portion of the overall length of the mailbox cavity. Although it is desirable that the member 12 correspond substantially to the overall length or depth of the mailbox, it can extend along at least a portion of the length of the mailbox cavity so long as it is easily reachable by the hand of a user. In like fashion, the second transverse member 18 is sized so as to correspond substantially to the overall width of the mailbox M although, here again, it can extend along at least a portion of the width of the mailbox cavity so long as it is capable to engage and contact different sizes and shapes of mail placed within the mailbox cavity. In addition, the present device can be made from a wide variety of different materials including wood, plastic, composite materials and the like so long as such materials are capable of withstanding normal wear and tear due to the sliding and gliding action of the device within a particular mailbox structure.

Figure 6:
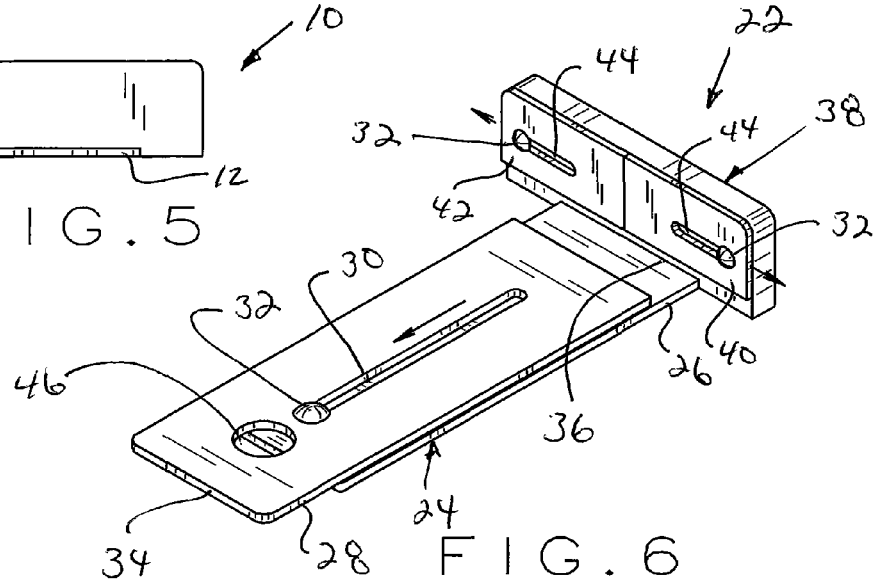
FIG. 6 is perspective view of another embodiment of the present mailbox device wherein the first elongated member is adjustable lengthwise and the second transverse member is adjustable widthwise.

FIG. 6 illustrates an alternative embodiment 22 of the present device which is specifically designed to accommodate variations in mailbox dimensions. In this particular embodiment, the present device 22 includes an adjustable elongated member 24 and an adjustable transverse member 38. More particularly, elongated member 24 includes a pair of members 26 and 28, member 28 being slidably positionable relative to member 26 so as to adjust the overall length thereof. In this particular embodiment, members 26 and 28 each include an elongated slot 30 positioned in registration with each other, each slot 30 being adaptable for receiving a fastening member or other device 32 for holding and locking member 28 in a particular position relative to member 26 so as to achieve the overall length or depth of the mailbox cavity into which the present device 22 will be inserted. In this regard, the slot 30 on member 28 can be formed such that fastening member 32 will be flush mounted with member 28, or member 32 can be a low profile member, so as not to impede or otherwise interfere with the sliding of the mail into the mailbox cavity. Member 28 can be moved fore and aft along the longitudinal plane of member 26 until its terminal end portion 34 lies substantially close to or in the vicinity of the access opening AO of the particular mailbox into which it will be inserted. On the other hand, the one end portion 36 of member 26 is coupled or otherwise attached to, or integrally formed with, transverse member 38 in a conventional manner as previously explained with respect to embodiment 10.

In similar fashion, transverse member 38 is attached to or near end portion 36 of member 26 as previously explained and likewise extends above member 28. Unlike transverse member 18, transverse member 38 includes a pair of slidable or adjustable wing portions 40 and 42 which can be each respectively extended outwardly in the direction of the arrows associated with FIG. 6 so as to extend the overall width of member 38. In this regard, each wing portion 40 and 42 includes an elongated slot 44 each of which is cooperatively positioned in registration with a corresponding slot or pair of slots (not shown) associated with member 38. In similar fashion, a fastening member or other device 32 is likewise insertable within the respective slots 44 and the corresponding slots associated with member 38 so as to hold and lock the wing portions 40 and 42 in their extended positions. As a result, this mechanism allows a user to adjust transverse member 38 laterally so as to correspond substantially to the overall width of the mailbox cavity into which it will be inserted. This adjustability in both the longitudinal (length or depth) and lateral (width) directions enables a user to adapt a single device 22 to accommodate a wide variety of differently sized and shaped street or roadside mailboxes regardless of the variation in their overall dimensions.

Although FIG. 6 discloses one method for adjusting the length of member 24 and the width of member 38, it is recognized and anticipated that a wide variety of different structures, shapes, configurations, constructions and designs could be utilized to accomplish the adjustability of members 24 and 38. For example, the elongated members 26 and 28 as well as transverse members 38, 40 and 42 could each be respectively telescopingly engageable with each other; a plurality of aligned, spaced apart corresponding openings could be used in place of the elongated slots 30 and 44; the member 38 could be a two-piece telescoping member thereby eliminating use of wing portions 40 and 42; an additional adaptor plate similar to one or both wing portions 40 and/or 42, or a single adaptor plate greater in length than member 38, can be coupled or otherwise attached to member 38 to extend the overall width thereof; and other constructions are envisioned and anticipated for adjusting the overall length of member 24 and for adjusting the overall width of member 38.

Like device 10, the present device 22 can be made from any suitable materials such as wood, plastic, a composite material, or other similar materials. In addition, elongated member 28 may likewise include a finger hole or other opening 46 for enabling the finger of a user to grasp the member 28 and slide the entire device 22 through the access opening of a particular mailbox as illustrated in FIG. 2. The device 22 will function and operate substantially identical to the device 10 explained above with respect to FIGS. 1 and 2.

Although the elongated members 12, 24 and 26 are illustrated as being substantially rectangular in shape, such members can take on a wide variety of other shapes so long as they are compatible with the dimensions of the floor of the mailbox cavity. Similarly, although the transverse members 18 and 38 are illustrated as being substantially rectangular, such members can likewise take on other shapes and can include curved portions so as to more substantially conform to the enclosed housing structure associated with a particular mailbox cavity. Other variations and modifications to the various components comprising the present structures are likewise envisioned and contemplated.

Thus, there has been shown and described several embodiments of a novel mailbox accessory device which is adaptable for use with a wide variety of different types of street or roadside mailboxes, which mailbox accessory device fulfills all of the objects and advantages sought therefor. Many changes, modifications, variations and other uses and applications of the present invention will, however, become apparent to those skilled in the art after considering this specification and the accompanying drawings. All such drawings, modifications, variations and other uses and applications which do not depart from the spirit and scope of the present invention are deemed to be covered by the present invention which is limited only by the claims which follow.

What is claimed is:

1. A one-piece mailbox device for insertion within the cavity of a mailbox, the mailbox including a rear wall, an access opening and an access door, the mailbox device comprising:

a first elongated member having flat top and bottom surfaces, opposed side edges, and opposed end edges, said opposed side edges extending upwardly and downwardly no further than said flat top and bottom surfaces, said first member extending along at least a portion of the length of said mailbox cavity and having a width less than the width of the mailbox cavity, said flat bottom surface resting upon the supporting floor surface of the mailbox cavity;

a second member extending along at least a portion of the width of the mailbox cavity and extending above said first member, said second member being straight and fixedly attached to said first member adjacent one of said opposed end edges of said first member and having opposed end portions which extend beyond the periphery of the opposed side edges of said first member such that said second member extends further across the width of the mailbox cavity as compared to said first member;

said device being insertable within the mailbox cavity such that said second member lies in the vicinity of the rear wall of the mailbox and the opposite end edge of said first member lies in the vicinity of the access opening of the mailbox;

said device being movable from a position wherein said second member lies in the vicinity of the rear wall of the mailbox to a position wherein said second member lies in the vicinity of the access opening of the mailbox.

2. The mailbox device defined in claim 1 wherein the opposite end edge of said first member includes an opening for grasping by a user's finger.

3. The mailbox device defined in claim 1 wherein said device is movable to a plurality of different locations wherein said second member lies between the rear wall and the access opening of the mailbox.

4. A mailbox device for insertion within the enclosed cavity of a mailbox, the mailbox including a rear wall, an access opening and an access door, the mailbox device comprising:

a first elongated member including a pair of members slidably positionable one on top of the other so as to adjust the overall length of said first member, said first member having first and second end portions, opposed side edges, and extending longitudinally along a substantial portion of the length of the mailbox cavity, said first member having an opening located in the vicinity of said first end portion;

a second transverse member including a pair of slidably movable wing portions so as to adjust the overall width of said second member, each wing portion having an end portion which extends beyond the periphery of the opposed side edges of said first member, said second transverse member extending along a substantial portion of the width of the mailbox cavity and being coupled to said first elongated member adjacent the second end portion of said first elongated member, said second transverse member extending above said first elongated member;

said device being slidably insertable within the mailbox cavity such that said second transverse member lies substantially adjacent the rear wall of the mailbox and the first end portion of said first elongated member lies substantially adjacent the access opening of the mailbox;

said device being slidably movable within the mailbox cavity from a position wherein said transverse member is located substantially adjacent the rear wall of the mailbox cavity to a position wherein said transverse member is substantially adjacent the access opening of the mailbox, said second transverse member being shaped to engage mail located in the mailbox cavity and to move said mail to the access opening of the mailbox when said second member is moved within the mailbox cavity.

5. The mailbox device defined in claim 4 wherein said pair of members associated with said first elongated member each include an elongated slot positioned in registration with each other, each slot being adaptable for receiving a fastening member for holding said pair of members in a particular position relative to each other to adjust the overall length of said first member.

6. The mailbox device defined in claim 4 wherein said second transverse member further includes a member in abutting relationship with said pair of wing portions, each wing portion including an elongated slot positioned in registration with at least one slot associated with said abutting member, each slot being adaptable for receiving a fastening member for holding said pair of wing portions in an extended position to adjust the overall width of said second member.

* * * * *